US006457859B1

(12) United States Patent
Lu et al.

(10) Patent No.: US 6,457,859 B1
(45) Date of Patent: Oct. 1, 2002

(54) INTEGRATION OF COOLING JACKET AND FLOW BAFFLES ON METAL FRAME INSERTS OF X-RAY TUBES

(75) Inventors: Qing Kelvin Lu, Aurora; Mark S. Maska, Palatine, both of IL (US)

(73) Assignee: Koninklijke Philips Electronics NV, Eindhoven (NL)

( * ) Notice: Subject to any disclaimer, the term of this patent is extended or adjusted under 35 U.S.C. 154(b) by 34 days.

(21) Appl. No.: 09/691,443

(22) Filed: Oct. 18, 2000

(51) Int. Cl.[7] ..... H01J 35/12

(52) U.S. Cl. ..... 378/199; 378/200; 378/130; 378/144

(58) Field of Search ..... 378/199, 130, 378/4, 200, 201, 202, 15, 144, 250

(56) References Cited

U.S. PATENT DOCUMENTS 4,369,517 A * 1/1983 Ozawa ..... 313/36
5,012,505 A 4/1991 Zupancic et al.
5,086,449 A 2/1992 Furbee et al.
5,299,249 A 3/1994 Burke et al.

* cited by examiner

*Primary Examiner*—Robert H. Kim
*Assistant Examiner*—George Wang
(74) *Attorney, Agent, or Firm*—Fay, Sharpe, Fagan, Minnich & McKee, LLP

(57) ABSTRACT

A CT scanner comprises a beryllium window mounted on an x-ray insert, a cooling fluid circulation line, and a cooling fluid return line. A plurality of fins are mounted in the cooling fluid circulation line. The fluid circulation line is in fluid communication with one of an anode side cavity and a cathode side cavity and in fluid communication with a heat exchanger. The fluid return line is in fluid communication with the heat exchanger and in fluid communication with the other one of the anode side cavity and the cathode side cavity. A pump means circulates the cooling fluid through the heat exchanger, the suction and return lines, and the x-ray tube housing assembly.

22 Claims, 5 Drawing Sheets

INTEGRATION OF COOLING JACKET AND FLOW BAFFLES ON METAL FRAME INSERTS OF X-RAY TUBES

BACKGROUND OF THE INVENTION

The present invention relates to the radiographic arts. It finds particular application in conjunction with x-ray tubes for computerized tomographic (CT) scanners and will be described with particular reference thereto. However, it is to be appreciated that the present invention may also be amenable to other applications.

CT scanners have commonly included a floor-mounted frame assembly which remains stationary during a scan and a rotatable frame assembly. An x-ray tube is mounted to the rotatable frame assembly which rotates around a patient receiving examination region during the scan. Radiation from the x-ray tube traverses the patient receiving region and impinges upon an array of radiation detectors. Using the position of the x-ray tube during each sampling, a tomographic image of one or more slices through the patient is reconstructed.

The x-ray tube typically comprises an x-ray tube insert holded a rotating anode and a stationary cathode and a lead lined housing. The x-ray tube insert is contained within the lead lined housing. Cooling oil is flowed between the x-ray tube insert and the housing. In large, high performance x-ray tubes, the x-ray insert may be a metal shell or frame with a window mounted or brazed thereon for allowing the transmission of x-rays from the x-ray tube. The window may be made of beryllium, titanium or any other x-ray transmitting material. Likewise, the housing defines an xray output window that is in alignment with the beryllium window of the metal frame such that x-rays pass directly through both the beryllium window and the x-ray output window.

During x-ray operation, electrons are emitted from a heated filament in the cathode and accelerated to a focal spot area on the anode. Upon striking the anode, some portion of the electrons, or secondary electrons, are bounced to the surrounding frame and converted into heat. The beryllium window receives the highest intensity of the secondary electron heating because the window is close to the focal spot on the anode. This heat is undesirable and is commonly termed waste heat. One of the persistent problems in CT scanners and other radiographic apparatus is dissipating the waste heat created while generating x-rays.

In order to remove the waste heat, a cooling fluid is often circulated between the housing and the metal frame intert to form a cooling flow path throughout the x-ray tube. For example, cooling oil is drawn through an output aperture located at one end of the housing, circulated through a radiator or heat exchanger and returned to an inlet aperture in the opposite end of the housing. The returned cooled fluid flows axially through the housing toward the outlet aperture, absorbing heat from the x-ray insert.

Removing waste heat in this manner is not always completely effective. More specifically, waste heat removal by merely forcing coolant to flow between the x-ray insert and the housing is particularly ineffective around the x-ray output window. The beryllium window and its environs, being the recipient of the secondary electrons and heat from the closely adjacent focal spot, is preferentially heated. Further, the beryllium window protrudes out from the frame and generally disrupts the flow of coolant around the window preventing optimal cooling. Additionally, the configuration of the x-ray output window on the housing disrupts coolant flow and, by its proximity to the beryllium window, limits the amount of coolant capable of passing over the beryllium window.

When the beryllium window is not sufficiently cooled, the heat can damage the braze joint between the beryllium window and the metal frame insert causing the x-ray tube to fail. Further, the coolant adjacent to the beryllium window may boil and leave a carbon residue on the beryllium window. Such a coating is undesirable as it may degrade the quality of the x-ray image.

The present invention provides a new and improved cooling system for overcoming the above-referenced drawbacks and others.

SUMMARY OF THE INVENTION

The present invention relates to the use of a cooling jacket and/or flow baffles around an x-ray insert to provide for the removal of undesirable waste heat from the x-ray tube insert, a beryllium window on the x-ray insert, and the area surrounding the beryllium window.

In accordance with one aspect of the present invention, a CT scanner comprises an x-ray tube mounted on a rotating frame portion. The x-ray tube includes an x-ray insert and a housing. The x-ray insert is mounted in the housing between an anode side cavity and a cathode side cavity with a cooling fluid path surrounding the x-ray insert and running between the anode and cathode side cavities. The x-ray tube has a beryllium window mounted on the x-ray insert, a cooling fluid circulation line, and a cooling fluid return line. The fluid circulation line is in fluid communication with one of the anode side cavity and the cathode side cavity and in fluid communication with a heat exchanger. The fluid return line is in fluid communication with the heat exchanger and in fluid communication with the other one of the anode side cavity and the cathode side cavity. The CT scanner additionally comprises a pump means and a plurality of fins mounted in the cooling fluid circulation line. The pump means circulates the cooling fluid through the heat exchanger, the suction and return lines, and the x-ray tube housing.

In accordance with another aspect of the present invention, an x-ray tube comprises a housing, an x-ray insert, and a plurality of baffles. The housing has an x-ray window and defines a housing cavity therein. The x-ray tube includes a vacuum envelope which holds an anode and a cathode. The vacuum envelope has a beryllium window adjacent the anode. The x-ray insert is mounted in the housing spaced from the housing by an annular fluid path with the beryllium window aligned with the x-ray window. The plurality of baffles is mounted in the flow path for directing cooling fluid toward the beryllium window.

In accordance with another aspect of the present invention, a method of cooling an x-ray tube is provided. A cooling fluid is circulated through an x-ray tube housing. Heat is removed from an x-ray insert disposed within the x-ray tube housing by allowing the circulating cooling fluid to flow adjacent the x-ray insert. Heat is removed from a beryllium window disposed on the x-ray insert by forcing the cooling fluid to converge toward the beryllium window. The forcing is caused by a plurality of baffles disposed angularly relative to the flow direction of the circulating cooling fluid. Heated cooling fluid is removed from the x-ray tube housing. Cooling fluid is cooled and recirculated through the x-ray tube housing.

The advantages of the present invention include the ability to prevent or reduce the risk of thermal damage to the joint between the beryllium window and the metal frame insert.

Another advantage resides in reducing or preventing failure of the x-ray insert due to overheating.

Another advantage of the present invention resides in reducing or preventing carbon build-up on the beryllium window due to overheating of the cooling fluid.

Still other advantages and benefits of the invention will become apparent to those skilled in the art upon a reading and understanding of the following detailed description.

BRIEF DESCRIPTION OF THE DRAWINGS

The invention may take form in various components and arrangements of components, and in various steps and arrangements of steps. The drawing is only for purposes of illustrating a preferred embodiment and is not to be construed as limiting the invention.

DETAILED DESCRIPTION OF THE PREFERRED EMBODIMENT

Figure 1:
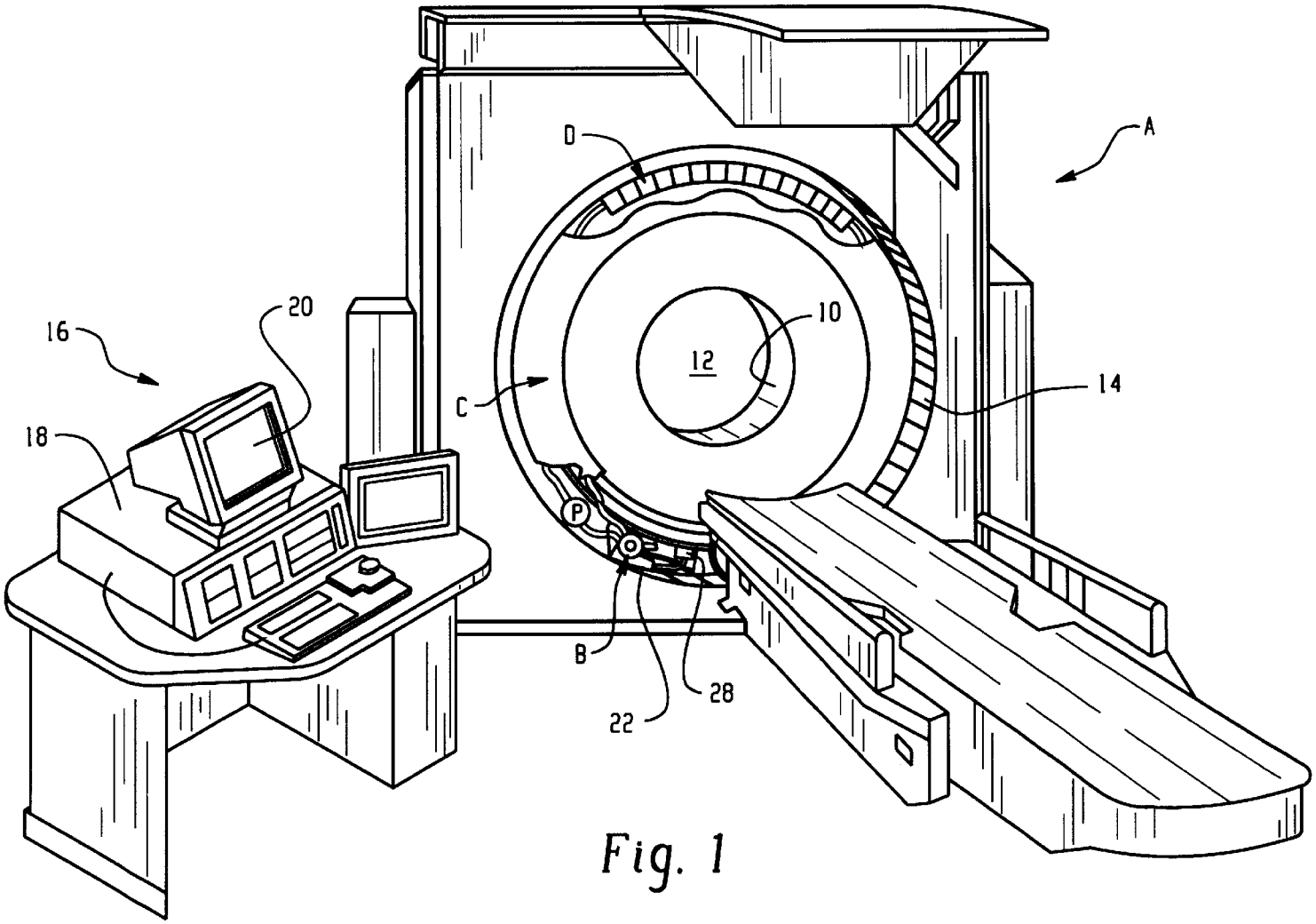
FIG. 1 is a diagrammatic illustration of a CT scanner in accordance with the present invention.

With reference to FIG. 1, a CT scanner includes a floor mounted or stationary frame portion A whose position remains fixed during data collection. An x-ray tube B is mounted on a rotating frame C rotatably mounted within the stationary frame portion A. Heat generated by the x-ray tube B is transferred to a heat exchanger D by a cooling fluid, such as oil, water, refrigerant gas, other fluids and combinations thereof.

The stationary frame portion A includes a bore 10 that defines a patient receiving examination region 12. An array of radiation detectors 14 are disposed concentrically around the patient receiving region 12. The stationary frame A with the rotating frame C can be canted or tipped to scan slices at selectable angles. A control console 16 contains an image reconstructing processor 18 for reconstructing an image representation of output signals from the detector array 14, performing image enhancements, and the like. A video monitor 20 converts the reconstructed image representation into a human readable display. The console 16 also includes appropriate digital recording memory media for archiving the image representations. Various control functions, such as initiating a scan, selecting among different types of scans, calibrating the system, and the like are also performed at the control console 16.

Figure 2:
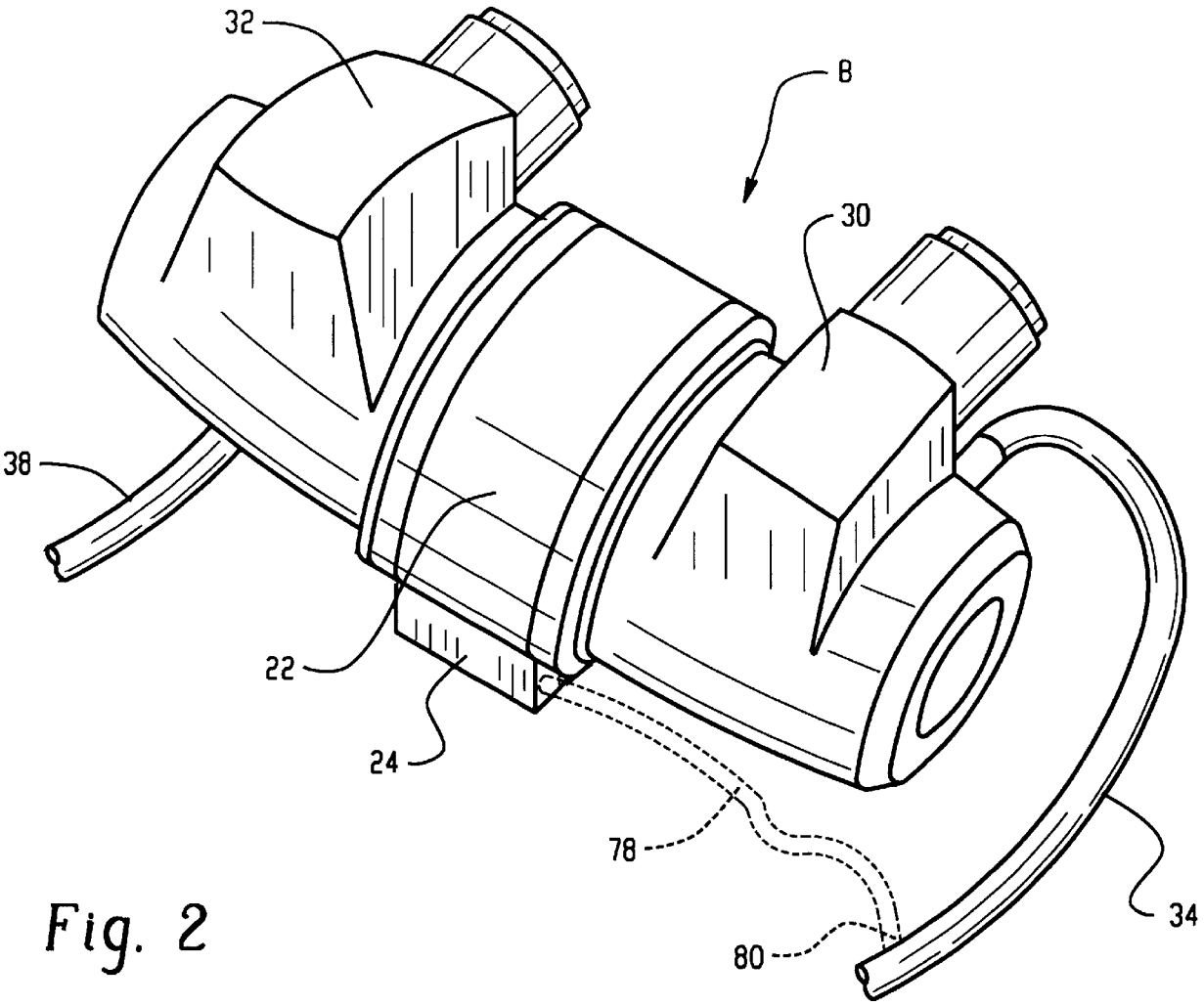
FIG. 2 is a perspective view of the x-ray tube housing of the scanner of FIG. 1.
Figure 3:
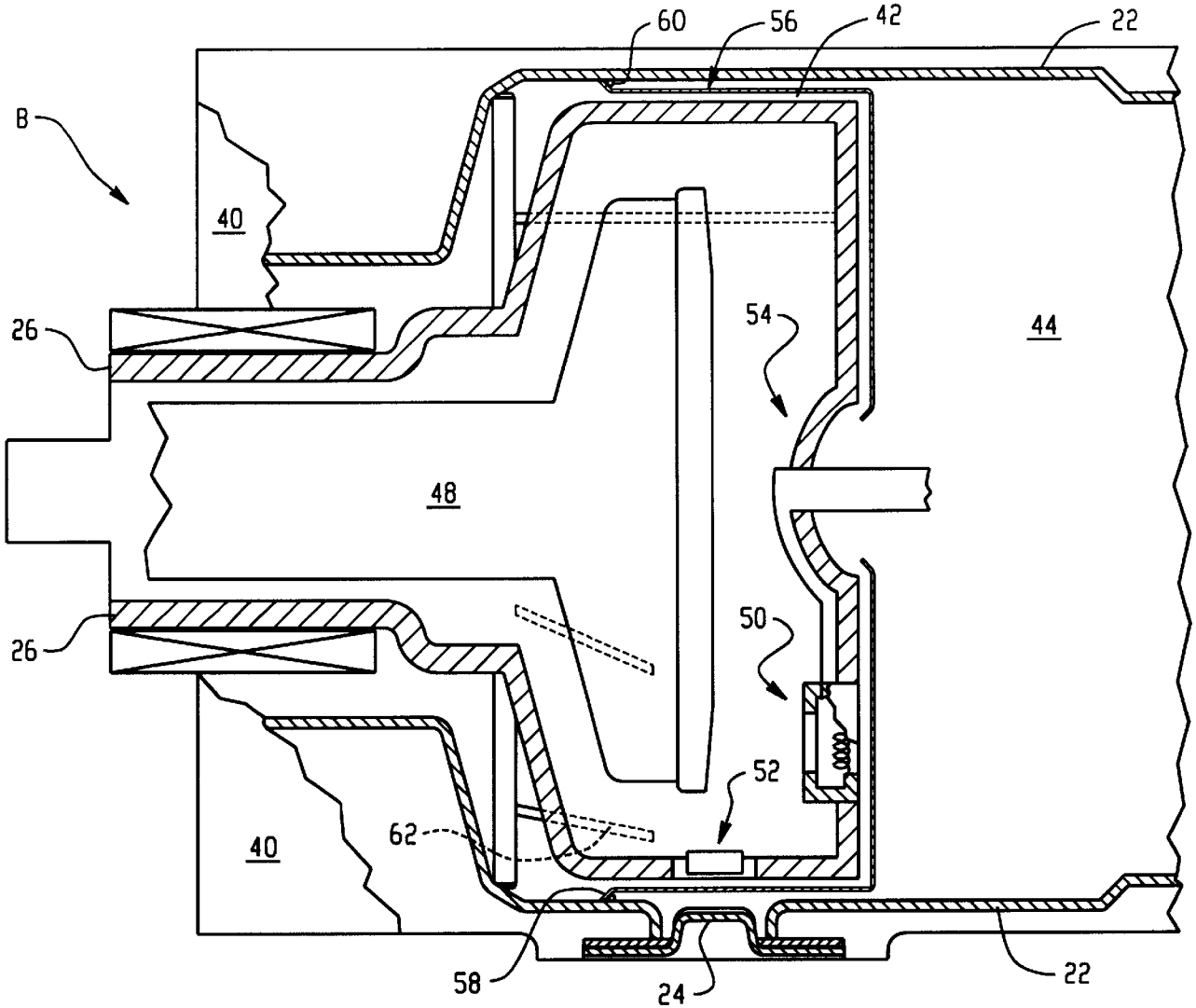
FIG. 3 is a diagrammatic cross-sectional illustration of the x-ray tube housing of FIG. 2, a contained x-ray insert, and a cooling jacket.

With further reference to FIGS. 2 and 3, the x-ray tube B includes a cooling fluid filled housing 22 that has an x-ray permeable window 24 directed toward the patient receiving region 12. The contoured profile of the x-ray permeable window 24 deviates substantially from the inner walls of the housing 22. A housing cavity is disposed within the housing 22 for holding an x-ray insert 26.

The x-rays pass through the x-ray permeable window 24 and across the patient receiving region 12. Appropriate x-ray collimators focus the radiation into one or more planar beams which span the examination region 12 in a fan or cone pattern, as is conventional in the art. Other equipment associated with the x-ray tube B, such as a high voltage power supply 28, are also mounted on the rotating frame C.

With specific reference to FIG. 2, in a first preferred embodiment, the x-ray tube housing 22 defines a cathode side portion 30 and an anode side portion 32 through which electrical leads are passed. Heated cooling fluid is circulated from inside the cathode side portion 30 of the x-ray tube housing 22 through a first cooling fluid duct 34 to a heat exchanger D on the rotatable frame C. Circulation of the cooling fluid is effected by a fluid pump 36. Cooled cooling oil exiting from the heat exchanger D is returned to the anode side portion 32 via a second cooling fluid duct 38. The cooling fluid enters the anode side portion 32 through an anode side aperture (not shown) and flows into an anode side cavity 40 which is defined by a portion of the housing cavity. The fluid passes from the anode side cavity 40 through an annularly disposed cooling fluid path 42 to remove heat created during x-ray generation and into a cathode side cavity 44 defined by another portion of the housing cavity. The fluid exits the cathode side portion 30 by flowing from the cathode side cavity 44 through a cathode side aperture (not shown) into the first cooling fluid duct 34 and recirculates back to the heat exchanger D.

With specific reference to FIG. 3, the x-ray insert or metal frame 26 defines a vacuum envelope for holding a rotary anode 48 which is rotatably mounted in the metal frame 26 by bearings (not shown). A cathode 50 is mounted adjacent the rotary anode 48. Electrons from the cathode 50 are propelled by high voltage against the anode 48 causing the emission of x-rays and heat. The metal frame insert 26 includes a beryllium window 52 mounted adjacent the cathode 50 and the x-ray permeable window 24 of the housing 22. The beryllium window 52 passes x-rays generated by the cathode 50 and the anode 48 out of the metal frame insert 26 through the x-ray permeable window 24 and into the patient receiving area 12. The beryllium window 52 is attached to the metal frame insert 26 by brazing or by any other suitable manner. Electrical leads for supplying current to the cathode 50 and leads for biasing the cathode 50 to a large, negative potential difference relative to the anode 48 pass through the metal envelope in a cathode well 54.

Figure 4:
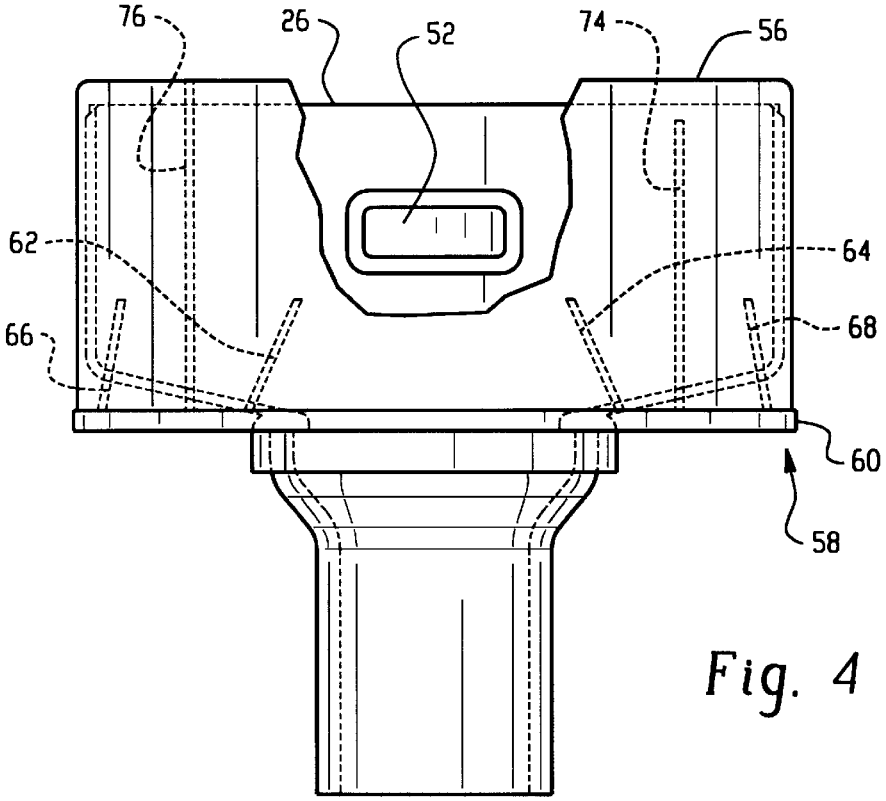
FIG. 4 is a top view in partial section of the x-ray insert and cooling jacket of FIG. 3.
Figure 5:
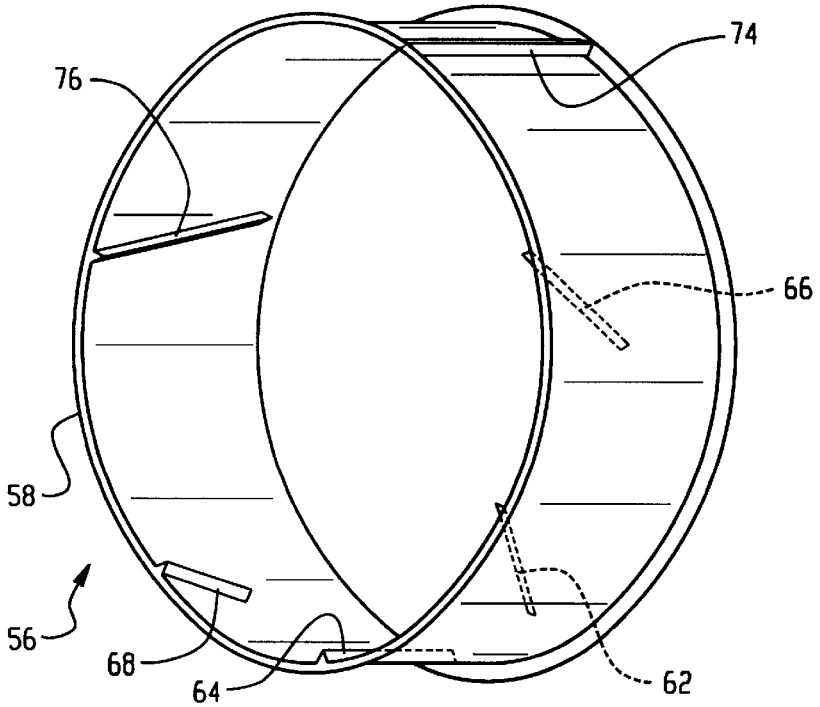
FIG. 5 is a partial perspective view of a cooling jacket in accordance with the present invention.
Figure 6:
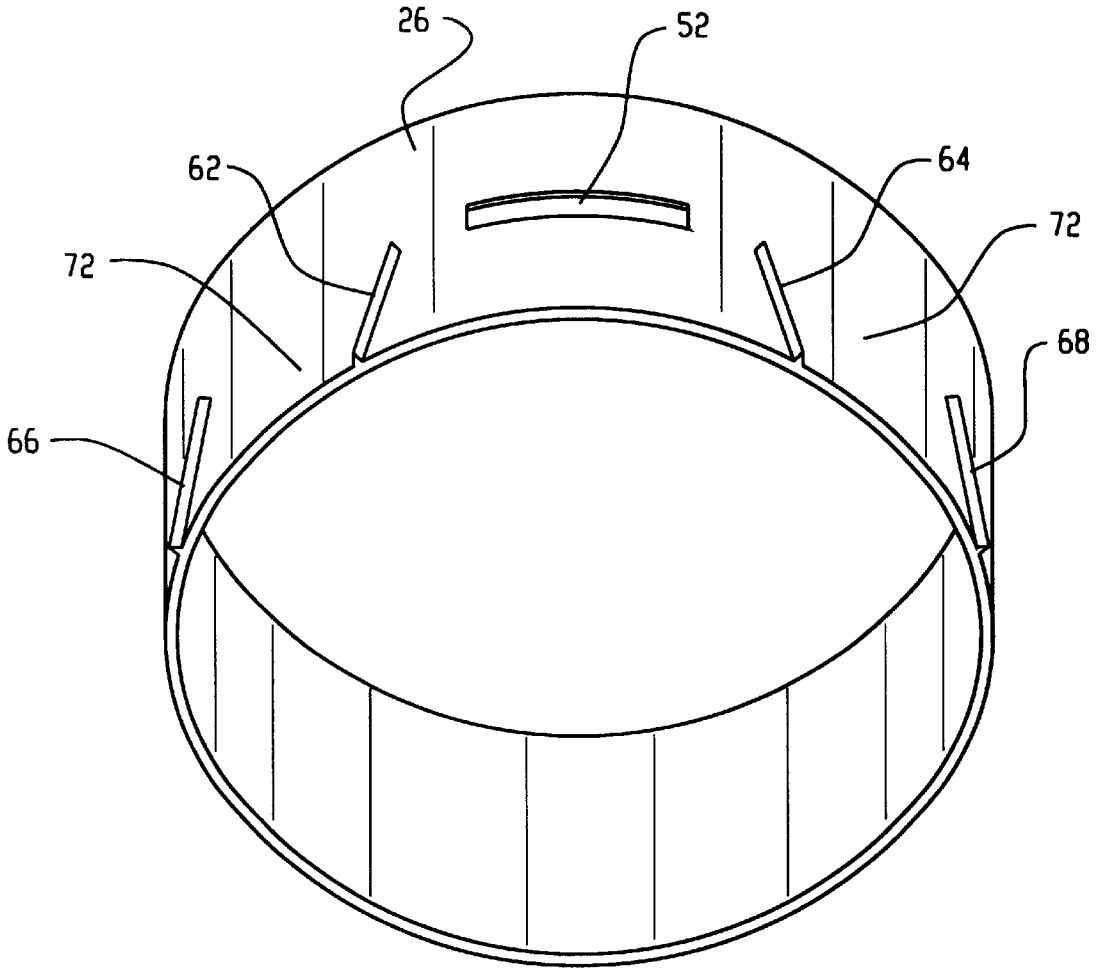
FIG. 6 is a partial perspective view of an alternate embodiment of the metal frame insert in accordance with the present invention.

With continuing reference to FIG. 3 and further reference to FIGS. 4 and 5, a generally cylindrical cooling jacket 56 is mounted around the metal frame insert 26. The cooling jacket 56 and the metal frame insert 26 together define the annularly cooling fluid flow path 42 between the anode side cavity 40 and the cathode side cavity 44. The cooling jacket 56 is preferably made of aluminum but can be made of other low-Z metals, plastic coupled with an aluminum piece facing the beryllium window 52, or the like. The cooling jacket 56 or, alternatively, the aluminum piece attached to a plastic cooling jacket, functions as an x-ray filter plate at or near the beryllium window 52. Of course, the materials and shape of the cooling jacket 56 can vary and it is to be appreciated that all such varying materials and shapes are to be considered within the scope of the present invention.

With specific reference to FIG. 3, the cooling jacket 56 includes a flared opening 58 located at the entrance of the flow path 42 to allow for smooth coolant flow. The jacket 56 conforms to the general shape of the metal frame insert 26 and directs fluid along the metal frame insert 26. The jacket 56 opens to the cathode side cavity 44 at or near the cathode well 54 of the metal frame insert 46 causing fluid exiting the flow path 42 to cool the pass through on the cathode well 54 before entering the cathode side cavity 44. An O-ring seal 60 is mounted between the housing 22 and the flared opening 58 of the jacket 56 to prevent fluid from bypassing the flow path 42.

With continuing reference to FIGS. 4 and 5, a principal set of baffles 62, 64 and an auxiliary set of baffles 66, 68 are mounted to an inside surface of the jacket 56. The baffles 62–68 extend from the jacket 56 to the wall of the metal vacuum envelope 46 adjacent the beryllium window 52. Further, the baffles 62–68 extend axially along the length of the jacket 56 from an axial edge of the jacket 56 nearest the anode side portion 32 to respective positions on either side of the beryllium window 52. The baffles 62–68 converge, preferably at sixty-five degrees from a transverse direction. The axial length, height, and angle of each of the baffles 62–68 can vary.

The primary baffles 62, 64 direct and accelerate cooling fluid toward the beryllium window 52. The primary baffles 62, 64 are located one each on either side of the beryllium window 52 approximately thirty-three degrees around the cooling jacket 56 relative to the beryllium window 52. The secondary baffles 66, 68 direct and accelerate cooling fluid toward hot zone areas 70, 72 created by the primary baffles 62, 64. Hot zone areas 70, 72 are created behind the primary baffles 62, 64 where cooling fluid is directed away toward the beryllium window 52. All of the baffles 62–68 also serve to maintain a preselected fixed space between the metal frame insert 26 and the cooling jacket 56. For maximizing heat transfer, the spacing of the jacket 56 from the metal frame insert 46 is designed based on the specified coolant flow rate in maximum power of the CT scanner and to maintain a desirable flow pattern.

A plurality of guiding standoffs 74, 76 are concentrically opposite the baffles 62–68 and extend between the metal frame insert 26 and the interior wall of the cooling jacket 56. Like the baffles 62–68, the guiding standoffs 74, 76 are used to maintain an appropriate amount of spacing between the metal insert 26 and the jacket 56. The standoffs 74, 76 engage grooves in the metal frame 26 to assure alignment of the beryllium window 52 and the baffles 62–68.

With reference back to FIG. 2, alternatively, the baffles 62–68 are mounted on the exterior surface of the metal frame 26 and extend toward the jacket 56.

In a second preferred embodiment, the fluid path 42 is defined between the metal frame insert 26 and the housing 22. Thus, the housing 22 serves as the cooling jacket. The baffles 62–68 extend between the metal frame insert 26 and the housing 22. Guiding standoffs are eliminated.

With reference back to FIG. 2, a second flow line 78 of cooling fluid is introduced at or near the beryllium window 52 to enhance cooling on the window 52 according to a third preferred embodiment. A small flow distributor 80 is mounted at or near the entrance to the second flow line 78 to divide the cooling fluid exiting the heat exchanger D between the flow channel 42 and the second flow line 78. The fluid flow channel 42 delivers cooling fluid to the baffles 62-68 and the area around the beryllium window 52 in the manner described above. The second flow line 78 delivers fluid directly to the beryllium window 52. The diameter of the second flow line 78 is such that the flow rate in the second flow line 78 is at least ten percent (10%) of the flow rate passing into the flow channel 42.

The invention has been described with reference to the preferred embodiments. Obviously, modifications and alterations will occur to others upon a reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A CT scanner comprising:

an x-ray tube assembly mounted on a rotating frame portion, the x-ray tube assembly including an x-ray tube and a housing, the x-ray tube being mounted in the housing between an anode side cavity and cathode side cavity with a cooling fluid path surrounding the x-ray tube and running between the anode and cathode side cavities;

a beryllium window mounted on the x-ray tube;

a cooling fluid suction line in fluid communication with one of the anode side cavity and the cathode side cavity and in fluid communication with a heat exchanger;

a cooling fluid return line in fluid communication with the heat exchanger and in fluid communication with the other of the one of the anode side cavity and the cathode side cavity;

a pump means for circulating cooling fluid through the heat exchanger, the suction and return lines, and the x-ray tube housing assembly; and a plurality of baffles mounted in the cooling fluid path directing the circulated cooling fluid toward the beryllium window.

2. The CT scanner as set forth in claim 1 wherein the x-ray tube includes a cooling jacket operatively mounted between the housing and the x-ray insert, the cooling fluid path being defined between the cooling jacket and the x-ray insert.

3. The CT scanner as set forth in claim 2 wherein the baffles are mounted to one of the x-ray tube and the cooling jacket and extend to the other of the x-ray tube and the cooling jacket for directing the cooling fluid toward selected areas of the cooling fluid path.

4. A CT scanner comprising:

an x-ray tube assembly mounted on a rotating frame portion, the x-ray tube assembly including:

a housing, an x-ray tube mounted in the housing between an anode side cavity and a cathode side cavity, a cooling jacket mounted between the housing and the x-ray tube, and a cooling fluid path defined between the cooling jacket and the x-ray tube and running between the anode and cathode side cavities;

a window mounted on the x-ray tube;

a cooling fluid circulation line in fluid communication with one of the anode side cavity and the cathode side cavity and in the fluid communication with a heat exchanger;

a cooling fluid return line in fluid communication with the heat exchanger and in fluid communication with the other of the one of the anode side cavity and the cathode side cavity;

a pump which circulates the cooling fluid through the heat exchanger, the circulation and return lines, and the x-ray tube housing assembly; and baffles mounted to one of the x-ray tube and the jacket to direct cooling fluid toward the window.

5. The CT scanner as set forth in claim 1 wherein the baffles converge toward the beryllium window to increase cooling fluid flow over the window.

6. The CT scanner as set forth in claim 1 wherein the x-ray tube assembly includes:

a cooling jacket for providing laminar coolant flow around the beryllium window, the cooling jacket and the x-ray tube together defining the flow path;

the baffles including at least one primary baffle is operatively mounted to the frame insert for directing coolant toward the beryllium window, and the at least one auxiliary baffle is operatively mounted to the frame insert for directing coolant toward a hot area near each of the at least one primary baffle.

7. The CT scanner as set forth in claim 1 wherein the x-ray tube includes a second flow line in fluid communication with the heat exchanger, the second flow line capable of providing cooled fluid to the beryllium window and an area adjacent the beryllium window on the x-ray insert.

8. An x-ray tube comprising:

a housing having an x-ray window and defining a housing cavity therein;

an x-ray insert including a vacuum envelope which holds an anode and a cathode, the vacuum envelope having a beryllium window adjacent the anode, the x-ray insert mounted in the housing spaced from the housing by an annular fluid path with the beryllium window aligned with the x-ray window; and a plurality of baffles mounted in the flow path for directing cooling fluid toward the beryllium window.

9. The x-ray tube as set forth in claim 8 wherein a cooling jacket is mounted between the housing and the x-ray insert narrowing the annular fluid path.

10. The x-ray tube as set forth in claim 9 wherein a seal is mounted between the housing and the jacket to prevent fluid from bypassing the annular fluid path.

11. The x-ray tube as set forth in claim 9 wherein the cooling jacket includes a folding portion that folds around at least one end of the x-ray insert.

12. The x-ray tube as set forth in claim 11 wherein the at least one end of the x-ray insert has a feed through capable of receiving electrical wiring, the folding portion of the cooling jacket causing cooling fluid to cool the feed through.

13. The x-ray tube as set forth in claim 9 wherein at least one standoff is disposed between the cooling jacket and the x-ray insert to maintain a preselected space therebetween.

14. The x-ray tube as set forth in claim 8 wherein the plurality of baffles includes at least one set of converging primary baffles and at least one set of converging secondary baffles.

15. The x-ray tube as set forth in claim 8 wherein the x-ray tube includes a metal frame insert, the vacuum envelope being substantially defined by the metal frame insert, and the beryllium window mounted on the metal frame insert.

16. A method of cooling an x-ray tube, the method comprising:

circulating a cooling fluid through an x-ray tube housing;

removing heat from an x-ray insert disposed within the x-ray tube housing by allowing the circulating cooling fluid to flow adjacent the x-ray insert;

removing heat from a beryllium window disposed on the x-ray insert by forcing the cooling fluid to converge toward the beryllium window, the forcing caused by a plurality of baffles disposed angularly relative to the flow direction of the circulating cooling fluid;

removing the heated cooling fluid from the x-ray tube housing;

cooling the cooling fluid and recirculating the cooling fluid through the x-ray tube housing.

17. The method as set forth in claim 16 wherein the second step of removing heat from an x-ray tube includes the step of:

creating laminar flow of cooling fluid adjacent the x-ray insert by directing the cooling fluid to flow between the x-ray insert and a cooling jacket operatively disposed around the x-ray insert.

18. The method as set forth in claim 16 wherein the third step of removing heat from the beryllium window includes the step of:

accelerating cooling fluid toward the beryllium window.

19. The method as set forth in claim 18 wherein the third step of removing heat from the beryllium window includes the step of:

thinning the amount of cooling fluid allowed to flow adjacent to the beryllium window.

20. The method as set forth in claim 16 wherein the third step of removing heat from the beryllium window includes the step of:

supplying supplemental cooling fluid to the beryllium window.

21. A CT scanner comprising:

an x-ray tube assembly mounted on a rotating frame portion, the x-ray tube assembly including an x-ray tube and a housing, the x-ray tube being mounted in the housing between an anode side cavity and a cathode side cavity with a cooling fluid path surrounding the x-ray tube and running between the anode and cathode side cavities;

a window mounted on the x-ray tube;

a cooling fluid circulation line in fluid communication with one of the anode side cavity and the cathode side cavity and in fluid communication with a heat exchanger;

a cooling fluid return line in fluid communication with the heat exchanger and in fluid communication with the other of the one of the anode side cavity and the cathode side cavity;

a means for circulating cooling fluid through the heat exchanger, the circulation and return lines, and the x-ray tube housing assembly; and a means for accelerating the cooling fluid across the window to remove heat.

22. An x-ray tube assembly comprising:

a housing having a first x-ray window and defining a housing cavity therein;

an x-ray tube including a vacuum envelope which holds an anode and a cathode, the vacuum envelope having a second x-ray window adjacent the anode, the x-ray tube mounted in the housing spaced from the housing by an annular fluid path with the first and second x-ray windows aligned; and a means for directing cooling fluid in the fluid path to converge toward the second window.

* * * * *